US005827578A

United States Patent [19]

Bell

[11] Patent Number: 5,827,578

[45] Date of Patent: Oct. 27, 1998

[54] PROCESS AND DEVICE FOR DEACIDIFYING PRINTED MATERIAL AND PAPER PRODUCTS OF ALL KINDS

[76] Inventor: Oswald Bell, Passauer Str. 16, 90480 Nurnberg, Germany

[21] Appl. No.: 835,651

[22] Filed: Apr. 10, 1997

Related U.S. Application Data

[63] Continuation of PCT/DE95/01377 Oct. 13, 1994.

[30] Foreign Application Priority Data

Oct. 13, 1994 [DE] Germany ..... 44 36 635.3

[51] Int. Cl.[6] ..... B05D 1/40

[52] U.S. Cl. ..... 427/479; 118/313; 118/315; 118/626; 118/629; 427/336; 427/424

[58] Field of Search ..... 427/424, 439, 427/336, 479; 118/313, 626, 315, 629

[56] References Cited

U.S. PATENT DOCUMENTS

| | | | |
|---|---|---|---|
| 3,703,353 | 11/1972 | Kusterer, Jr. et al. | 162/160 X |
| 4,051,276 | 9/1977 | Williams et al. | 427/395 X |
| 4,860,685 | 8/1989 | Smith | 118/300 |
| 5,393,562 | 2/1995 | Sebera | 427/255.4 X |

FOREIGN PATENT DOCUMENTS

| | | |
|---|---|---|
| A 2 666 355 | 3/1992 | France . |
| A 38 08 429 | 9/1989 | Germany . |
| A 41 14 075 | 11/1992 | Germany . |
| A 42 18 203 | 12/1993 | Germany . |

*Primary Examiner*—Michael Lusignan
*Attorney, Agent, or Firm*—Merchant, Gould, Smith, Edell, Welter & Schmidt

[57] ABSTRACT

The present invention concerns a process as well as a device for deacidification of printed materials and paper products of all kinds, especially books. In order to avoid the so-called half-moon effect, i.e., an inadequate treatment caused by the narrow spaces between the individual book pages in the region of the book spine (7), with the invention the air jet, e.g., in the form of double jet consisting of an opening jet (10) and an active-substance jet (11), is so positioned relative to the book (1) that the active-substance jet and/or the opening jet enters essentially from one side (e.g., the bottom side) of the book (1) and exits at the opposite-lying side (e.g., the top side). Appropriately, the opening jet (10) as well as the active-substance jet (11) are inclined relative to the book spine (7). The active-substance jet (11) is moved relative to the book (1) by means of a swing arm (3).

25 Claims, 7 Drawing Sheets

PROCESS AND DEVICE FOR DEACIDIFYING PRINTED MATERIAL AND PAPER PRODUCTS OF ALL KINDS

This is a continuation of PCT/DE95/01377 application filed 13 Oct., 1994.

The present invention concerns a process for deacidifying printed material and paper products of all kinds, e.g., books, as well as a device for implementing the process.

The acid content of books in the long term causes a destruction of the books. In order to protect books against an acid-caused decomposition it is therefore necessary that the acid content of the pages be neutralized through introduction of an alkaline substance and further that a reserve of the alkaline substance be built up that counteracts a renewed acidification of the paper.

A generic process is already known from DE 41 14 075 A1. The treatment occurs here in the form of an air jet containing the active substance, which jet is directed against the free-hanging cut surfaces of a book set up in the form of a roof, and is shifted horizontally, i.e., from one book cover to the other. The process has the disadvantage that the treatment of the book pages is not effective or is only effective in a limited way, especially in the region of the book spine, i.e., where the pages are situated only a small distance from each other. This results in a half-moon-shaped area (as the particular page is seen in plan view) in which there is a region where no treatment or only a limited but inadequate amount of treatment ("half-moon effect") results. If this half-moon effect should arise, it leads to the destruction of the book concerned in the region of the spine, with the remaining regions of the respective pages indeed having been treated but nevertheless not being able to prevent the decomposition.

The task of the present invention consists herein, to make available a process for deacidification of printed material and paper products as well as a device for implementation of the process, through which process and device the half-moon effect can be effectively avoided. Further, the process should be simply realizable.

The task is solved with the generic process through the features of the characterizing parts of claim 1 or the characterizing parts of claim 12. The special manner and way of entry of the air jet into the positioned book assures that the spreading out of the individual pages takes place even in the region of the book spine; as a result of this the active substance can be brought effectively into these regions. At the same time an airflow inside the book between the individual pages to be treated is also maintained in the region of the book spine due to the arrangement of the book with respect to the air jet. The damming effect found with the prior art mentioned in the introduction does not arise.

The introduction of the active substance between the individual pages directly at the book spine is, in addition, made easier by the fact that the air jet is in several parts, i.e., it is built up of several separate air jets. An air jet (opening jet) takes care of the optimal fanning out of the individual pages of the whole book and another air jet (active-substance jet) introduces the active substance between the individual fanned-out pages of the book.

The opening of the pages directly in the region of the book spine is appropriately increased by the fact that the opening jet is inclined toward the book spine.

Usefully, the active-substance jet is also somewhat inclined toward the book spine; through this the penetration of the active substance into the critical region of the book spine can be improved.

A further arrangement of the process according to the invention is characterized by the fact that another air jet (widening jet), not loaded with active substance, is provided for, which further increases the distance between the book pages in the region of the book spine, in which the active-substance jet impinges. Through this an effective widening in the region of the book spine is accomplished and as a result an improved introduction of the active substance occurs.

This widening jet is preferably also inclined toward the book spine where the inclination angle corresponds as a minimum to the inclination angle of the related active-substance jet; preferably it is even larger than the inclination angle of the active-substance jet. Here the widening jet is arranged at the side of the related active-substance jet that is turned away from the book spine.

In order to effect a uniform treatment and a shortening of the treatment time, it is expedient to move the active-substance jet and the widening jet relative to the book in such a way that the jets scan the space spanned by both book covers and the book pages.

The objects of claims 8 and 9 represent measures which further improve the adhesion of the particles of active substance contained in the air jet to the individual book pages, especially in the region of the book spine.

The opening jet is appropriately planned to be in a fixed location relative to the positioned book and dimensioned in such a way that it effects a uniform fanning out of books of different sizes.

The nozzles for generating the active-substance jets as well as the widening jets are appropriately arranged on a driven swinging arm. The swinging arm can show a multiplicity of active-substance nozzles and nozzles for the widening jet. In this case, in order to achieve reasonable treatment results, the nozzles are arranged so that starting with the book spine there is first an active-substance jet, then a widening jet, then after that another active-substance jet, and so forth. The pressures of the individual widening jets should decrease proceeding from the book spine outward.

Claims 23–24 on the other hand treat suitable arrangements for increasing the adhesion of the active-substance particles during the treatment of the book.

In order to avoid an undesired post-cleaning of the book binding, i.e., of the book covers, a support is appropriately provided utilizing upper and lower clamping elements and provision is made for plates on the outside that approach the book cover but leave an intermediate space. The support is fitted with a blast nozzle, which during the treatment allows a blowing out of the intermediate spaces formed at the outside of the cover of the book, and in this way it prevents an undesired deposition of active substance on the book cover, i.e., on the binding of the book.

A suitable implementation of the device according to the invention for deacidification of books is elucidated with the help of the following figures. They show:

FIG. 1 A greatly simplified schematic front view representation of a book positioned for treatment in a fanned-out condition;

FIG. 2 The arrangement according to FIG. 1 in side view;

FIG. 3 The carrying arm including the nozzles for the active-substance jet and for the transport jet respectively in greatly simplified schematic representation.

FIG. 4 A greatly simplified schematic representation of the support with blast nozzle along with a book placed in the support, in plan view;

FIG. 5 The upper clamping element and

FIG. 6 a side view of the upper and lower clamping elements along with a book cover located between them.

Figure 1:
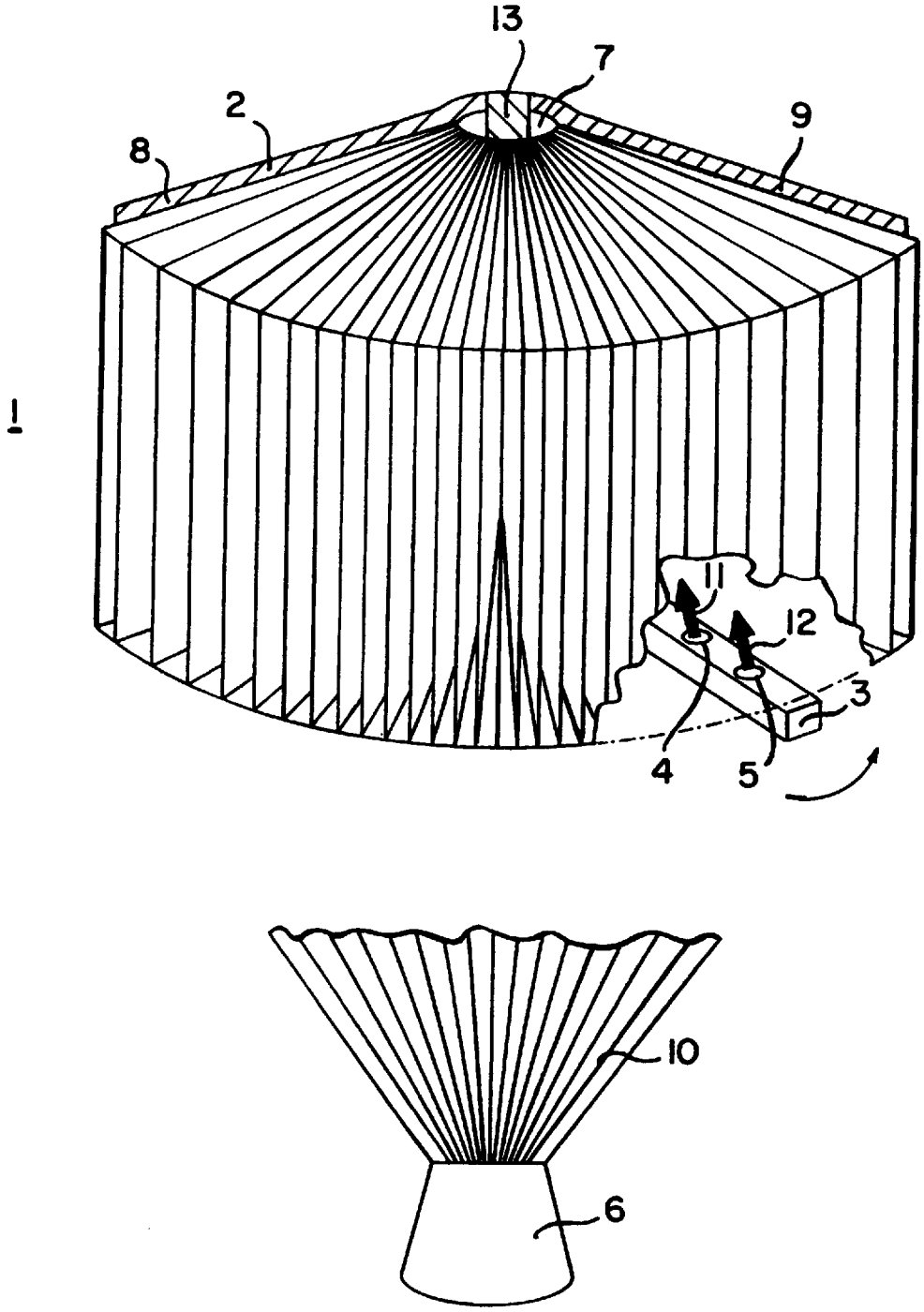

Reference numerals in FIG. 1 show the book 1 positioned in a frame-type support 2. The book 1 is arranged to be standing in the support 1, where the book covers 8,9 and the individual book pages are spread out as a sector-shaped surface (maximum 180°).

The positioning of the book 1 to be treated occurs in a simple way, that is, the book by way of both its covers 8,9 is set into the frame-formed support 2 and is fixed in place by one of the knifelike bars 13 clamping the inside of the book spine 7.

At the bottom of the book 1, a large-dimensioned nozzle 6, driven at low pressure and fixed in position relative to the book 1, is provided for generation of an opening jet 10. The opening jet 10 enters at the underside of the book 1 between the individual pages, and leaves the fanned out book 1 at its upper side. This assures a uniform fanning out of the whole book 1 positioned in the support 2.

At the bottom of the book a motor-driven swinging arm 3 is provided for, whose swing axis (not represented) lies approximately in the region of the book spine 7, so that during its swinging motion the swinging arm 3 can scan along a circular path the fanned out surface made up of the book covers 8,9 and the pages.

At the upper side of the swinging arm 3, leading out from the book spine 7 toward the outside, are provided, one in each case, a nozzle 4 for an active-substance jet 11 and nozzle 5 for a widening jet 12.

The active-substance jet 11 is loaded with fluidized active substance; the widening jet 12 utilizes pure air. The active-substance jet 11 as well as the widening jet 12 are arranged in a line along the swinging arm 3.

The widening jet 12 effects an additional widening of the region of the book impinged on by the active-substance jet. In this way active substance is introduced in an effective manner into such regions in the vicinity of the book spine that could not be treated up to now with conventional processes.

During the motion of the swinging arm 3 the active-substance jet 11 as well as the widening jet 12 blow on the individual pages of the spread out book, where during the treatment the opening jet 10 at the same time takes care of a total fanning out of the individual pages that are to be treated.

Figure 2:
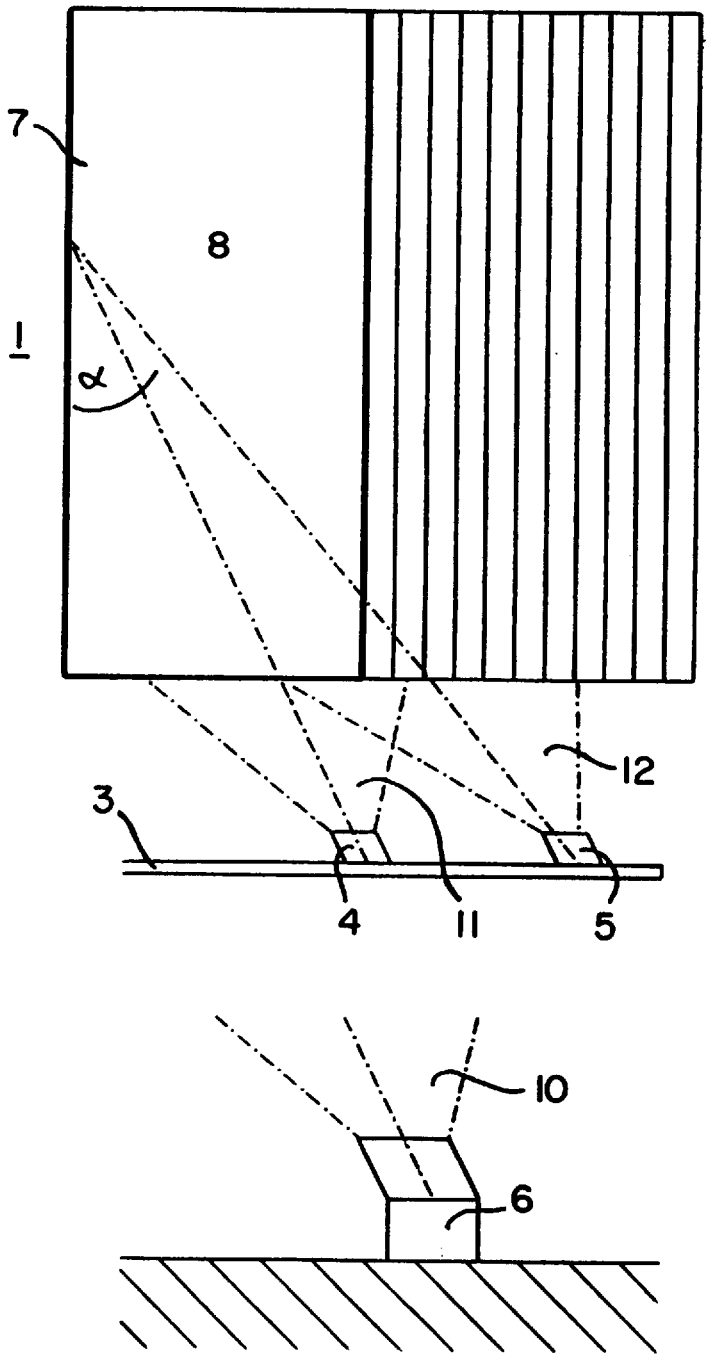

FIG. 2 shows the arrangement according to FIG. 1 in side view. Here it is clear that the opening jet 10 of the large-volume nozzle 6 is tilted at a definite angle toward the book spine 7, through which means an effective opening of all the pages relative to each other is assured, especially in the region of the book spine 7. Beyond that the nozzles located on the swinging arm for generation of the active-substance jet 11 as well as jet 12 are in each case inclined at a definite angle toward the book spine 7 in such a way that the inclination angle relative to the book spine 7 of the widening jet 12 is greater than the inclination angle relative to the book spine 7 of the active-substance jet 11.

Proceeding from the book spine 7 there is provided on the swinging arm 3 first of all a nozzle 4 for the active-substance jet 11, then a nozzle 5 for the widening jet 12. Provision can also be made for several nozzles 4 for several active-substance jets 11 as well as for several nozzles 5 for several widening jets 12 in an alternating series, in order to improve the intensity of the treatment.

During the treatment, at the same that time the opening jet 10 is operating, the swinging arm 3 swings once or—if desired-several times, as the case may be, over the surface of the book which is spread out at the underside, through which a treatment of the individual pages is accomplished, especially in the region of the book spine 7.

Figure 3:
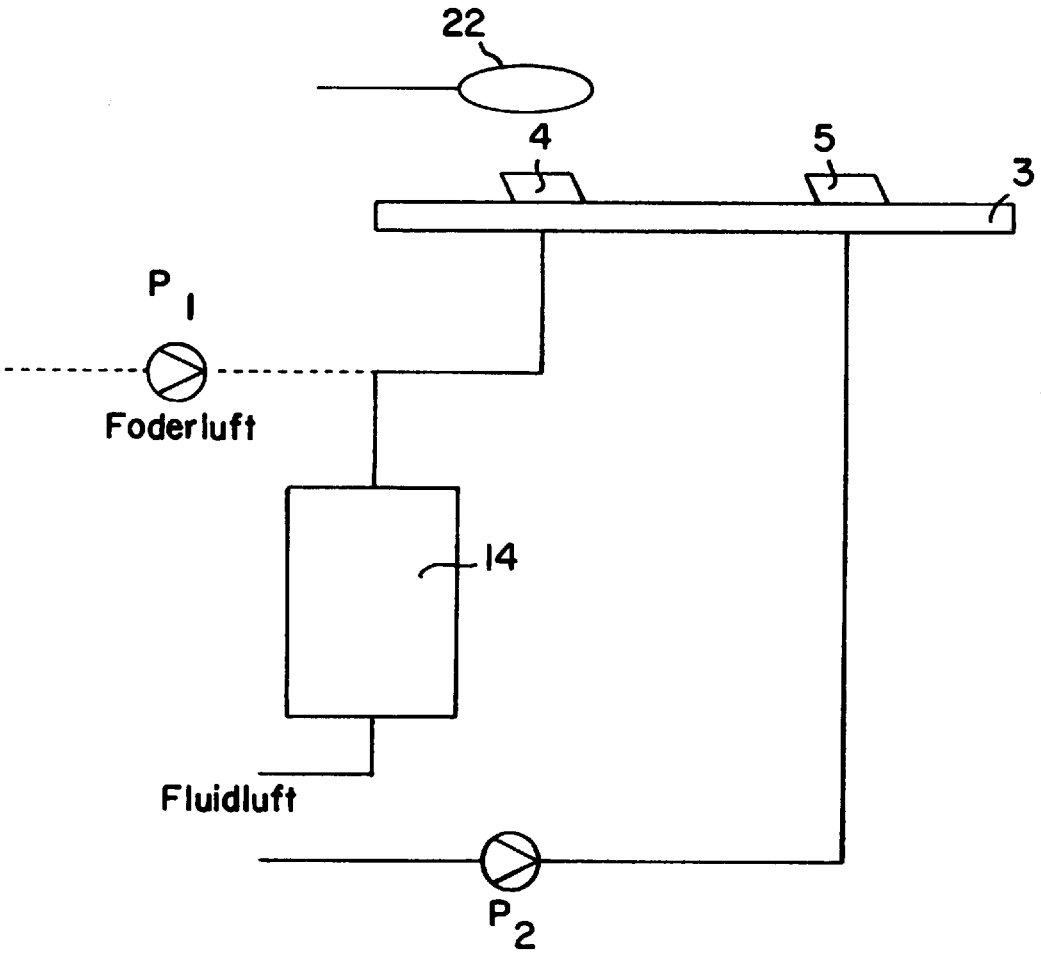

FIG. 3 shows the supply of the individual nozzles 4 and 5 for the active-substance jet 11 and the widening jet 12 respectively. The active substance is first fluidized in a fluidizing chamber 14 and then lead to the nozzle 4. Provided that several nozzles 4 for active-substance jets as well as several nozzles 5 for widening jets are provided along the swinging arm, the pressure relationships are to be chosen so that the pressures of the individual widening jets decrease when viewed from the inside of the swinging arm or, to be precise, from the book spine 7 looking toward the outside.

The individual pages can be moistened after the treatment, by which means the mobility of the active substance is increased and with that its distribution is improved at the inside of the pages.

Beyond that there exists the possibility of electrostatically charging the active substance and of electrically grounding the book during the treatment, through which an increased precipitation of the active substance can be achieved on the individual pages. The electrostatic charging results appropriately from a friction segment or by aid of a corona discharge (for example by blowing the active-substance jet through a discharge loop 22 or something similar).

Figure 4:
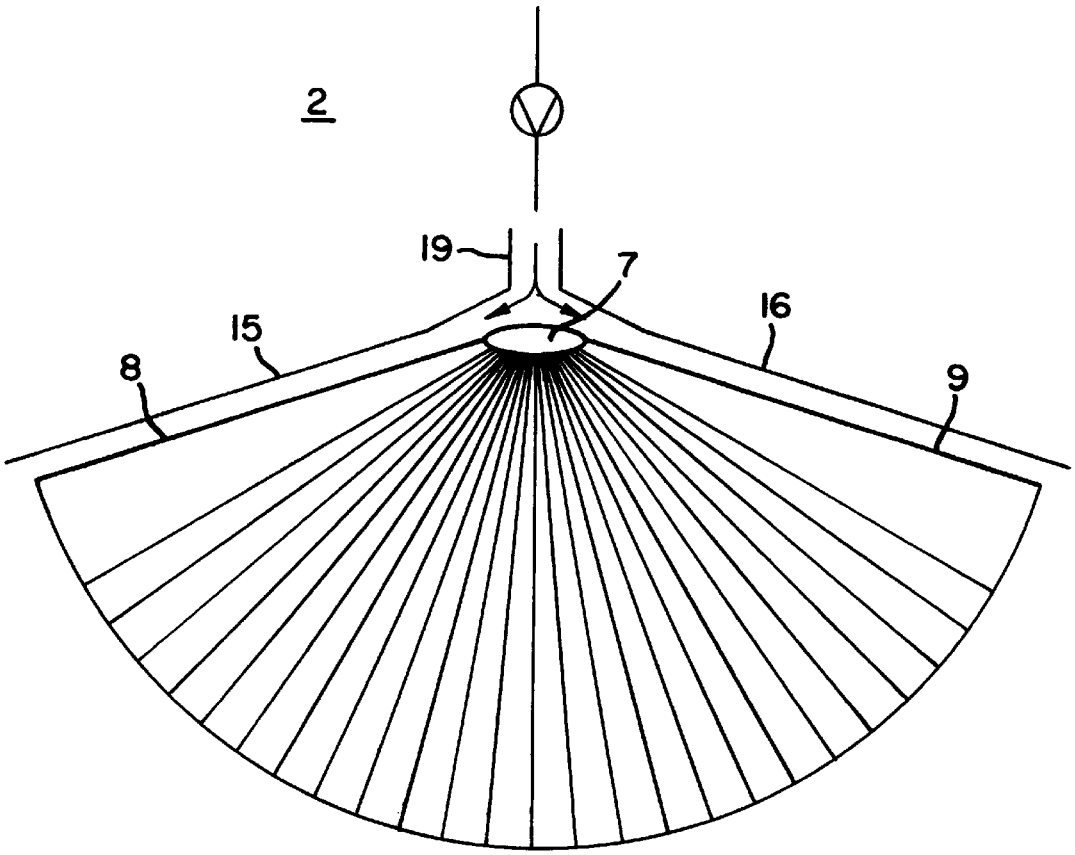
Figure 5:
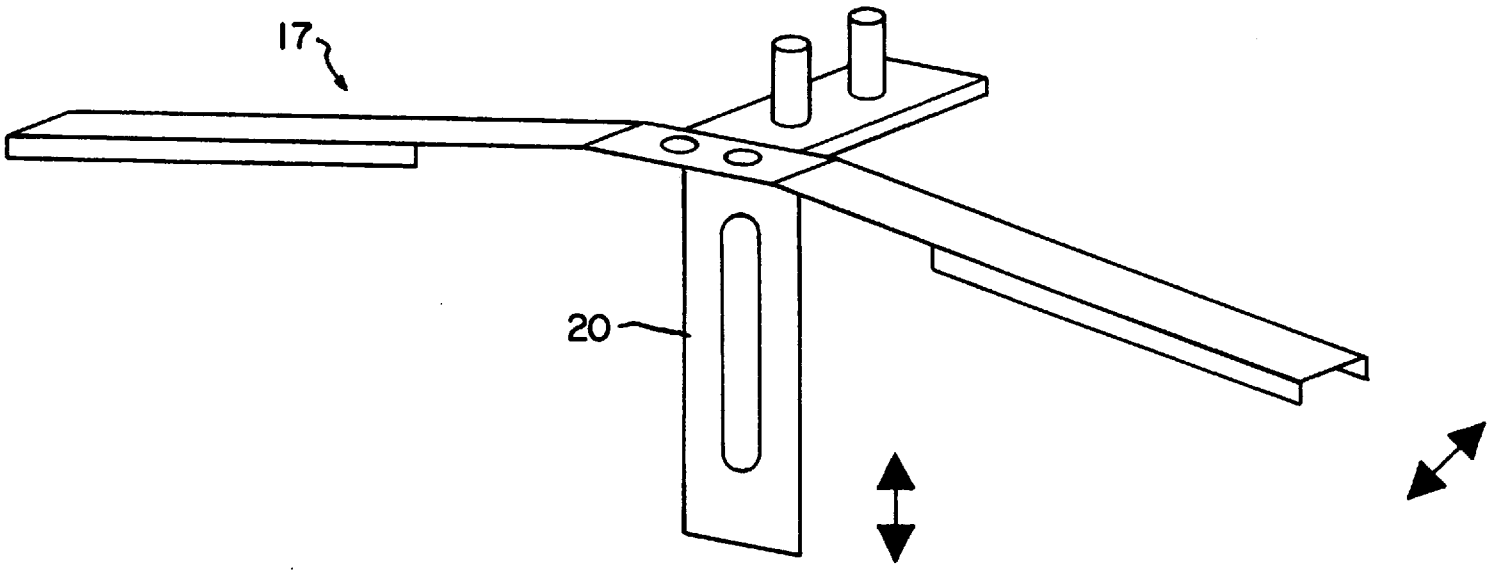
Figure 6:
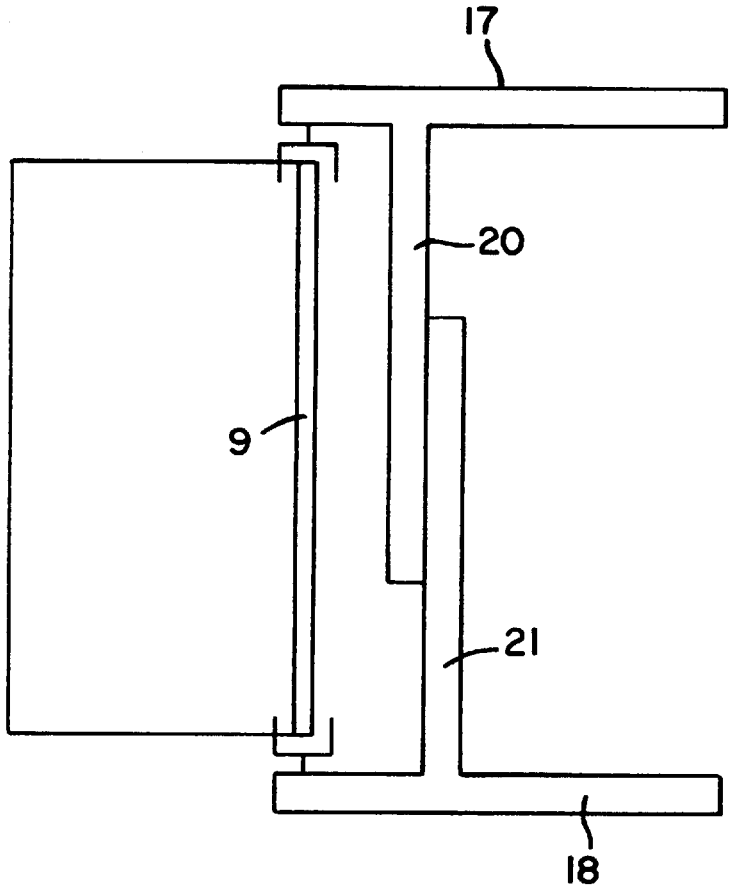
Figure 8:
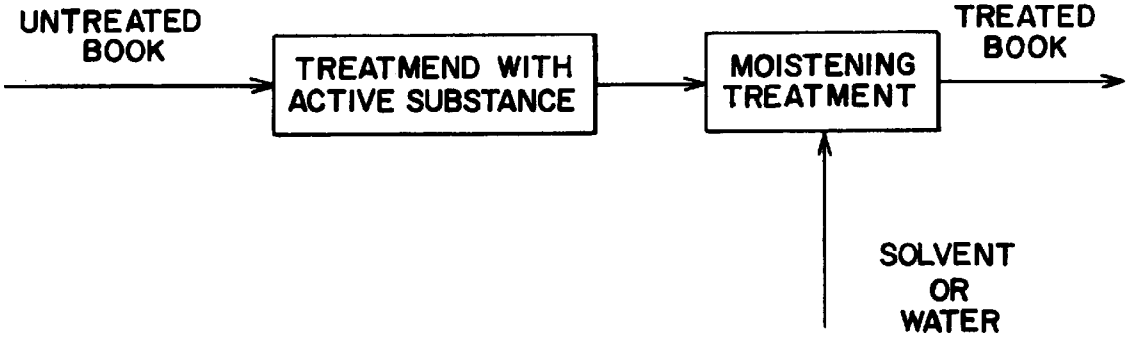
FIG. 8 shows the principal stations passed by a book which has to be treated, with the moistening treatment box including means for moistening.
Figure 7:
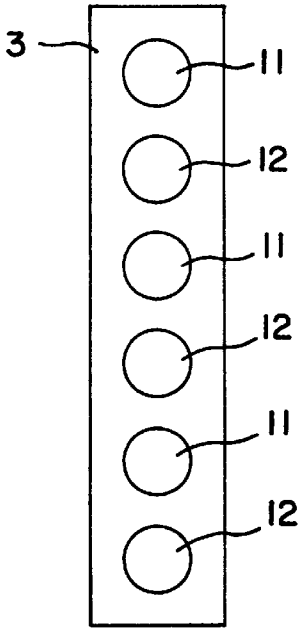
FIG. 7 shows a top plan view of the carrier comprising a plurality of nozzles arranged in alternating series.

FIGS. 4–6 show a special type of support for the book for carrying out the treatment in which a post-cleaning of the book binding, i.e., the book covers 8,9 is avoided.

For the covering of the respective book covers 8, 9 from one side, two panels 15, 16 are provided; these work together in an appropriate way with clamping elements (17, 18). The book is set by the two book covers 8, 9 into the upper and lower clamping elements 17, 18 (compare FIGS. 5 and 6) where the height can be adjusted by means of an upper and a lower locking element 20, 21. Finally each book cover is swung toward the corresponding panel 15, 16, whereby an intermediate space between the panels and the respective book cover results.

In the region of the book spine 7 at least one blast nozzle 19 is provided, by means of which during the treatment air pressure can be brought into the intermediate space formed in each case. The intermediate spaces 15, 16 can therefore be continuously blown out during the treatment, through which means dust-like working substance can be prevented from settling on the binding, i.e., on the book covers 8, 9 or in the region of the book spine, as the case may be. Due to this, manual and therefore cost-intensive post-cleaning can be avoided.

The invention prevents a half-moon effect that arises with prior art, and it offers for this reason an effective and enduring treatment possibility for books—even for books that are already very old and are highly acid-laden. It thus appreciably enhances protection from deterioration due to acidic conditions. This guarantees an appreciable contribution to the technology in the area of dry deacidification of printed material and paper products.

REFERENCE CODE LIST

1 book
2 bracket
3 swinging arm
4 nozzle (active-substance jet)
5 nozzle (transport jet)

6 nozzle (opening jet)
7 book spine
8 book cover
9 book cover
10 opening jet
11 active-substance jet
12 transport jet
13 knifelike bar
14 fluidizing chamber
15 panel
16 panel
17 clamping element
18 clamping element
19 blast jet
20 locking element
21 locking element

I claim:

1. A process for deacidification of a book having pages and a book spine, comprising:

opening the book to an open state;

blowing on the open book using at least one air jet such that the air jet effects a fanning out of the pages of the book, the at least one air jet including an active substance therein to establish a deacidification of the pages;

wherein the at least one air jet is made up of at least one part, and the air jet is oriented relative to the book such that the air jet impinges on the book in a direction parallel or diagonal to the book spine.

2. The process according to claim 1, wherein the air jet is comprised of a plurality of separately generated air jets, and further comprising loading at least a first one of the separately generated air jets with the active substance and blowing at least a second one of the separately generated air jets onto the book to effect the fanning out of the pages.

3. The process according to claim 2, wherein the second air jet is angled toward the book spine.

4. The process according to claim 2, wherein the first air jet is angled toward the book spine.

5. The process according to claim 2, wherein the plurality of separately generated air jets includes a third air jet, and further comprising blowing the third air jet onto the pages in the region of the first air jet to increase the distance between the pages of the book in the region in which the active substance impinges on the book.

6. The process according to claim 5, wherein the third air jet is angled toward the book spine.

7. The process according to claim 5, further comprising moving the first air jet and the third air jet over the breadth of the open book.

8. The process according to claim 2, further comprising electrostatically charging the active substance in the first air jet and electrically grounding the book.

9. The process according to claim 8, further comprising moistening the book with a solvent or with water subsequent to treating the book with the active substance.

10. The process according to claim 9, wherein the moistening of the book is carried out within such a range that no post-drying is necessary.

11. The process according to claim 1, wherein the process occurs at less than atmospheric pressure.

12. A device for deacidification of a book having pages and a book spine, comprising:

at least one support in which the book to be treated is supported; and at least a first nozzle through which a first air jet ladened with an active substance is discharged so as to impinge upon the pages of the book, said first nozzle being arranged such that the first air jet impinges upon the book parallel or diagonally to the book spine.

13. The device according to claim 12, further comprising a second nozzle discharging a second air jet for effecting a fanning out of the pages of the book, said second nozzle being arranged such that the second air jet impinges upon the book parallel or diagonally to the book spine.

14. The device according to claim 13, wherein the first nozzle is angled toward the book spine.

15. The device according to claim 13, wherein the second nozzle is angled toward the book spine.

16. The device according to claim 13, further comprising a third nozzle adjacent the first nozzle for discharging a third air jet onto the pages of the book in the region of the first air jet and increase the distance between the pages.

17. The device according to claim 16, wherein the third nozzle is located a first distance from the book spine and the first nozzle is located a second distance from the book spine, said first distance being greater than said second distance, and the third nozzle is angled toward the book spine.

18. The device according to claim 17, wherein the third nozzle is angled relative to the book spine at a first inclination angle, and the first nozzle is angled relative to the book spine at a second inclination angle, said first inclination being greater than said second inclination angle.

19. The device according to claim 16, wherein the first nozzle and the third nozzle are mounted on a carrier, said carrier and the book being moveable relative to each other.

20. The device according to claim 19, wherein the carrier comprises a swing arm that is rotatably mounted in the region of the book spine, said swing arm being pivotable along an arcuate path past the pages of the book, and said first nozzle and said third nozzle being spaced from each other along a longitudinal axis of the swing arm.

21. The device according to claim 19, further comprising a plurality of said first nozzles and a plurality of said third nozzles, said plurality of first and third nozzles being arranged in alternating series on the carrier.

22. The device according to claim 21, wherein the pressures of the air jets discharged from the third nozzles decreases as the distance from the book spine increases.

23. The device according to claim 12, further including means for moistening the pages of the book.

24. The device according to claim 12, further including means for electrostatically charging the active substance.

25. The device according to claim 12, wherein the support includes a pair of panels, upper and lower clamping elements cooperable with said pair of panels to support the book, and a blast nozzle disposed between the pair of panels and the upper and lower clamping elements.

* * * * *